US011246397B2

(12) United States Patent
Nguyen

(10) Patent No.: US 11,246,397 B2
(45) Date of Patent: Feb. 15, 2022

(54) HARNESS FOR GOLF BAG

(71) Applicant: Phuong Nguyen, Piedmont, CA (US)

(72) Inventor: Phuong Nguyen, Piedmont, CA (US)

( * ) Notice: Subject to any disclaimer, the term of this patent is extended or adjusted under 35 U.S.C. 154(b) by 0 days.

(21) Appl. No.: 17/269,336

(22) PCT Filed: Aug. 19, 2019

(86) PCT No.: PCT/US2019/047004
§ 371 (c)(1),
(2) Date: Feb. 18, 2021

(87) PCT Pub. No.: WO2020/041166
PCT Pub. Date: Feb. 27, 2020

(65) Prior Publication Data

US 2021/0321750 A1 Oct. 21, 2021

Related U.S. Application Data

(60) Provisional application No. 62/721,707, filed on Aug. 23, 2018.

(51) Int. Cl.
*A45F 3/14* (2006.01)
*A63B 55/00* (2015.01)

(52) U.S. Cl.
CPC ..... *A45F 3/14* (2013.01); *A63B 55/408* (2015.10); *A45F 2003/146* (2013.01); *A63B 2225/09* (2013.01)

(58) Field of Classification Search
CPC ..... A45F 3/14; A45F 3/047; A45F 2003/146; A63B 55/408; A63B 2225/09
USPC ..... 224/191, 259, 576
See application file for complete search history.

(56) References Cited

U.S. PATENT DOCUMENTS 5,419,473 A 5/1995 Lamar
5,593,077 A * 1/1997 Izzo ..... A45F 3/14 224/627
5,704,530 A 1/1998 Scherer
5,950,889 A * 9/1999 Feldman, Jr. ..... A63B 55/408 224/259
5,979,727 A * 11/1999 Steurer ..... A63B 55/408 224/257
5,984,157 A 11/1999 Swetish
6,152,343 A * 11/2000 Shin ..... A45F 3/14 224/259
6,182,874 B1 * 2/2001 Feldman, Jr. ..... A45F 5/00 224/259
6,328,192 B1 12/2001 Sundara et al.
(Continued)

FOREIGN PATENT DOCUMENTS

KR 200161788 12/1999

OTHER PUBLICATIONS

International Search Report and Written Opinion dated Nov. 14, 2019 in Intrtnational Patent Application No. PCT/US2019/047004.

*Primary Examiner* — Nathan J Newhouse
*Assistant Examiner* — Lester L Vanterpool
(74) *Attorney, Agent, or Firm* — Haugen Law Firm PLLP

(57) ABSTRACT

A harness for quick attachment to and release from a golf bag is described that includes a plurality of interrelated weight shifting adjustments. The harness is easily coupled to a variety of golf bags to carry the bag in an approximately horizontal orientation. The harness is further easily adjusted to accommodate various statures of users.

18 Claims, 18 Drawing Sheets

(56) References Cited

U.S. PATENT DOCUMENTS 6,460,747 B1 * 10/2002 Tuerschmann ..... A45F 3/14 206/315.3
6,536,641 B1 3/2003 Sundara et al.
6,926,183 B2 9/2005 Chang
7,131,534 B2 * 11/2006 Enes ..... A45F 3/14 206/315.3
7,175,059 B2 2/2007 Copich
7,337,935 B1 * 3/2008 Glanville ..... A45F 3/04 224/262
7,559,443 B2 7/2009 Pratt et al.
7,931,178 B2 4/2011 Rome et al.
8,020,738 B2 9/2011 Storey
8,056,781 B1 11/2011 Rowe
8,172,117 B2 5/2012 Maggi
8,322,585 B2 * 12/2012 Herron ..... A45F 3/04 224/576
9,033,146 B2 5/2015 Higdon et al.
9,044,651 B2 * 6/2015 Campbell ..... A45F 3/14
9,089,188 B2 * 7/2015 Wear ..... A45C 13/30
9,155,374 B2 * 10/2015 Kacmarcik ..... A45F 3/14
9,295,319 B1 3/2016 Hilliard et al.
9,364,072 B2 6/2016 Hairston et al.
9,468,822 B2 10/2016 Mashburn et al.
9,848,687 B2 12/2017 Valesko
2001/0003344 A1 6/2001 Jarman
2002/0113105 A1 8/2002 Jarman
2003/0106916 A1 * 6/2003 Boone ..... B60N 2/2842 224/161
2004/0226838 A1 11/2004 Griffith
2005/0145517 A1 * 7/2005 Yang ..... A45F 3/14 206/315.3
2006/0151559 A1 7/2006 Gravseth
2006/0201981 A1 9/2006 Meyer
2006/0226183 A1 10/2006 Sanderson
2007/0045371 A1 * 3/2007 Cheung Hoi Kwan . A45C 3/00 224/627
2007/0262105 A1 * 11/2007 Tan ..... A45F 3/04 224/259
2009/0026241 A1 * 1/2009 Leyendecker ..... A45F 3/04 224/637
2009/0131355 A1 5/2009 Bot et al.
2011/0290844 A1 12/2011 Hoffman
2012/0111748 A1 5/2012 Couchois et al.
2012/0227209 A1 9/2012 Vinson
2012/0241341 A1 * 9/2012 Harris ..... A45C 13/30 206/315.3
2012/0267410 A1 * 10/2012 Loudenslager ..... A45F 3/047 224/627
2013/0119100 A1 5/2013 Ito et al.
2013/0160302 A1 * 6/2013 Pellenc ..... A45F 3/14 30/275.4
2013/0283492 A1 10/2013 Ernst, Jr. et al.
2015/0157115 A1 * 6/2015 Smith ..... A45F 3/047 224/633
2016/0317884 A1 11/2016 Barker
2017/0120117 A1 * 5/2017 MacDonald ..... A63B 55/408
2017/0120118 A1 5/2017 MacDonald
2019/0029403 A1 * 1/2019 Pacha ..... A44B 11/00

* cited by examiner

HARNESS FOR GOLF BAG

CROSS-REFERENCE TO RELATED APPLICATIONS

This application is a national stage of International Application Serial No. PCT/US2019/47004, filed on Aug. 19, 2019, which claims the filing benefit and priority of U.S. Provisional Patent Application Ser. No. 62/721,707 filed Aug. 23, 2018, the contents of each of which being incorporated herein by reference in their entireties.

TECHNICAL FIELD

The present invention relates generally to shoulder straps that are attached to a golf club bag, and more particularly relates to a shoulder harness that quickly detaches from a golf club bag. The shoulder harness of the invention includes a lumbar support, waist belt and a cinching system that allows the user to selectively vary the distribution of the weight of the golf club bag to the user's shoulders and hips. It is further unnecessary to remove the shoulder harness of the present invention before swing a club and hitting the golf ball.

BACKGROUND

Over the years the sport of golf has been enjoyed at many levels of skill. Although golf carts are preferred by some to manage the endurance required to navigate a lengthy golf course having varying terrain, others prefer to traverse the golf course on foot. Participating in the game of golf typically necessitates the use of a variety of different golf clubs to complete round of golf. When traversing the golf course on foot, the golfer typically carries or otherwise transports a variety of golf clubs in a compartmentalized bag. Depending upon the fitness of the user, the weight of a golf bag may become cumbersome and a chore to carry.

In the past, golfers have either carried their golf club bags with a carry handle and a single shoulder carry strap or have pulled the bag in a wagon or cart. More recently, golf bags have been provided with dual carry straps to allow a distribution of the weight of the bag over both of the user's shoulders. The user carries the bag from shot to shot but then typically will set the bag on the ground and remove the shoulder straps to allow an unfettered swing when attempting to hit a golf ball with a golf club selected from the bag. At times it may be physically strenuous for a user to remove the carry straps from the shoulders while attempting to position the golf bag on the ground. Although carrying straps have been previously provided on golf bags, the present invention provides a harness that quickly connects and disconnects from the bag which allows the user to wear the harness while golfing without interfering with the golf swing. The present invention further provides a carry harness having a cinching system that selectively distributes the weight of the golf bag to both the user's shoulders and hips.

SUMMARY

Embodiments according to aspects of the invention are capable of quickly attaching to a golf bag and allowing a user to spread out and control the weight distribution of the golf bag to both the user's hips and shoulders. The harness of the present invention generally includes a lumbar support, a hip or waist belt, shoulder strap, at least four cinching straps, a chest strap, and at least four interconnecting straps.

In embodiments of the invention the lumbar support, hip belt and shoulder straps are padded. Further, the cinching straps and interconnecting straps may utilize slides, clips, side release buckles, connecting buckle clips, ladder lock slider buckles or other buckle, clasp or clip to allow adjustment of the length of the straps. The attachment points of the straps to the shoulder straps, lumbar support and waist or hip belt further allow the user to select the amount of weight distributed to the shoulders and hips. In certain embodiments of the invention adjusting the lengths of the cinching straps further adjusts the stability of the bag as the user traverses the golf course.

The length adjustable first cinching strap has a first end that links a first end of the first padded shoulder strap to an upper end of the padded lumbar support and has a second end that links a second end of the first padded shoulder strap to at least one of the padded lumbar support and the padded hip belt. The length adjustable second cinching strap has a first end that links a first end of the second padded shoulder strap to the upper end of the padded lumbar support and has a second end that links a second end of the second padded shoulder strap to at least one of the padded lumbar support and the padded hip belt. The length adjustable third cinching strap has a first end linked to the upper end of the padded lumbar support, a second end linked to the padded hip belt, and a mid portion coupled to a belt buckle or first half of a side release buckle. The length adjustable fourth cinching strap has a first end linked to the upper end of the padded lumbar support, a second end linked to the padded hip belt, and a mid portion coupled to a belt buckle or second half of the side release buckle.

The first interconnecting strap has a first end linked to the upper end of the padded lumbar support and a second end adapted to couple to a golf bag. The second interconnecting strap has a first end linked to the upper end of the padded lumbar support and a second end adapted to couple to the golf bag. The third interconnecting strap has a first end linked to the padded hip belt and a second end adapted to couple to the golf bag. The fourth interconnecting strap has a first end linked to the padded hip belt and a second end adapted to couple to the golf bag. Also, the length adjustable cinching chest strap interconnects the first and second shoulder straps.

Additionally, embodiments of the harness in accordance with the present invention may provide the second end of the third cinching strap that is further linked to the first end of the third interconnecting strap. Also, the second end of the fourth cinching strap may further link to the first end of the fourth interconnecting strap. Further, the first end of the first cinching strap may be further linked to the first end of the first interconnecting strap. Additionally, the first end of the second cinching strap may be further linked to the first end of the second interconnecting strap. In this embodiment the height of the golf bag relative to the user's waist may be adjusted. The first interconnecting strap may couple to the golf bag with a first coupling member, the second interconnecting strap may couple to the golf bag with a second coupling member, the third interconnecting strap may couple to the golf bag with a third coupling member, and the fourth interconnecting strap may couple to the golf bag with a fourth coupling member. Additionally, the first end of the first padded shoulder strap may interconnect with a first end of the second padded shoulder strap.

Another embodiment according to aspects of the invention includes a harness for quick coupling to a golf bag, that includes a padded lumbar support, a padded hip belt, first and second padded shoulder straps, at least four length adjustable cinching straps, a length adjustable chest strap that interconnects the shoulder straps, and at least four interconnecting straps.

The length adjustable first cinching strap has a first end that links a first end of the first padded shoulder strap to an upper end of the padded lumbar support and has a second end that links a second end of the first padded shoulder strap to at least one of the padded lumbar support and the padded hip belt. The length adjustable second cinching strap has a first end that links a first end of the second padded shoulder strap to the upper end of the padded lumbar support and has a second end that links a second end of the second padded shoulder strap to at least one of the padded lumbar support and the padded hip belt. The length adjustable third cinching strap has a first end linked to the upper end of the padded lumbar support, a second end linked to the padded hip belt, and a mid portion coupled to a first half of a belt buckle of the side release type. The length adjustable fourth cinching strap has a first end linked to the upper end of the padded lumbar support, a second end linked to the padded hip belt, and a mid portion coupled to a second half of the side release buckle.

The first interconnecting strap has a first end linked to the upper end of the padded lumbar support and a second end adapted to couple to a golf bag, wherein the first end of the first cinching strap is further linked to the first end of the first interconnecting strap. The second interconnecting strap has a first end linked to the upper end of the padded lumbar support and a second end adapted to couple to the golf bag, wherein the first end of the second cinching strap is further linked to the first end of the second interconnecting strap. The third interconnecting strap has a first end linked to the padded hip belt and a second end adapted to couple to the golf bag, wherein the second end of the third cinching strap is further linked to the first end of the third interconnecting strap. The fourth interconnecting strap has a first end linked to the padded hip belt and a second end adapted to couple to the golf bag, wherein the second end of the fourth cinching strap is further linked to the first end of the fourth interconnecting strap. Those skilled in the art will appreciate that the various straps may be split and interconnected with slides, clips, side release buckles, connecting buckle clips, ladder lock slider buckles or other buckle, clasp or clip to allow additional adjustment and interconnectivity of the various straps.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
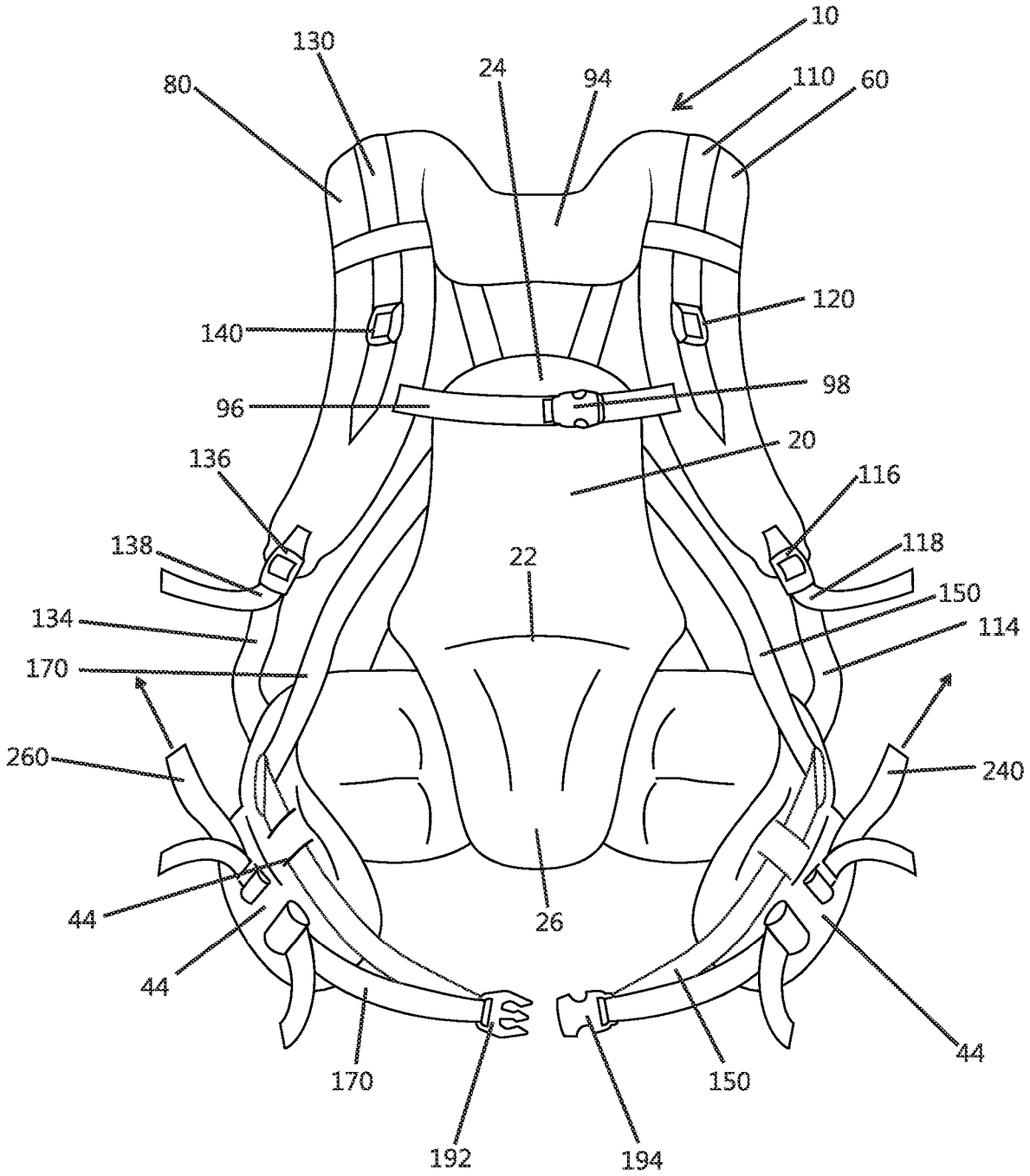
FIG. 1 is a front perspective view of an embodiment of a golf bag shoulder harness of the present invention.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The harness apparatus of the present invention is particularly well suited for carrying a golf bag while playing golf.

The present invention gives the user the option to either remove the harness before each golf shot or disconnect the harness from the golf bag before the golf shot. Although the invention will be described in the context of a harness that quickly attaches to a golf bag, the user may find other uses for the present invention. The harness apparatus 10 of the present invention generally includes a lumbar support 20, a hip or waist belt 40, shoulder straps 60 and 80, at least four cinching straps 110, 130, 150, and 170, a chest strap 96, and at least four interconnecting straps 200, 220, 240, and 260. In embodiments of the invention the lumbar support 20, hip belt 40 and shoulder straps 60 and 80 are padded. Further, the cinching straps 110, 130, 150, and 170 and interconnecting straps 200, 220, 240, and 260 may connect the harness to the golf bag 14 at varying connection points and with a variety of slides, clips, side release buckles, connecting buckle clips, ladder lock slider buckles or other buckle, clasp or clip thereby allowing adjustment of the straps in a variety of ways without departing from the scope of the inventions.

Figure 2:
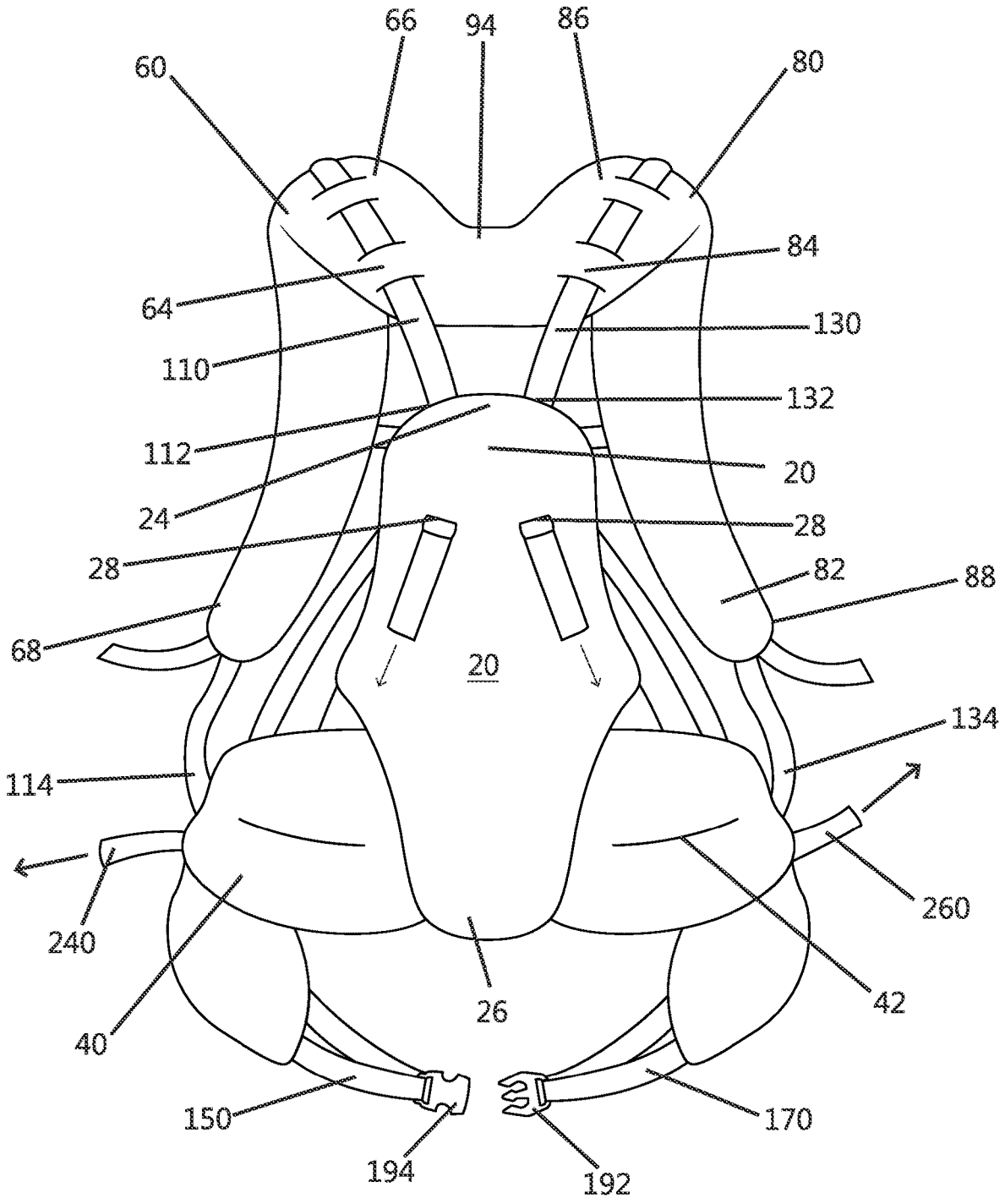
FIG. 2 is a back perspective view of an embodiment of a golf bag shoulder harness of the present invention.
Figure 3:
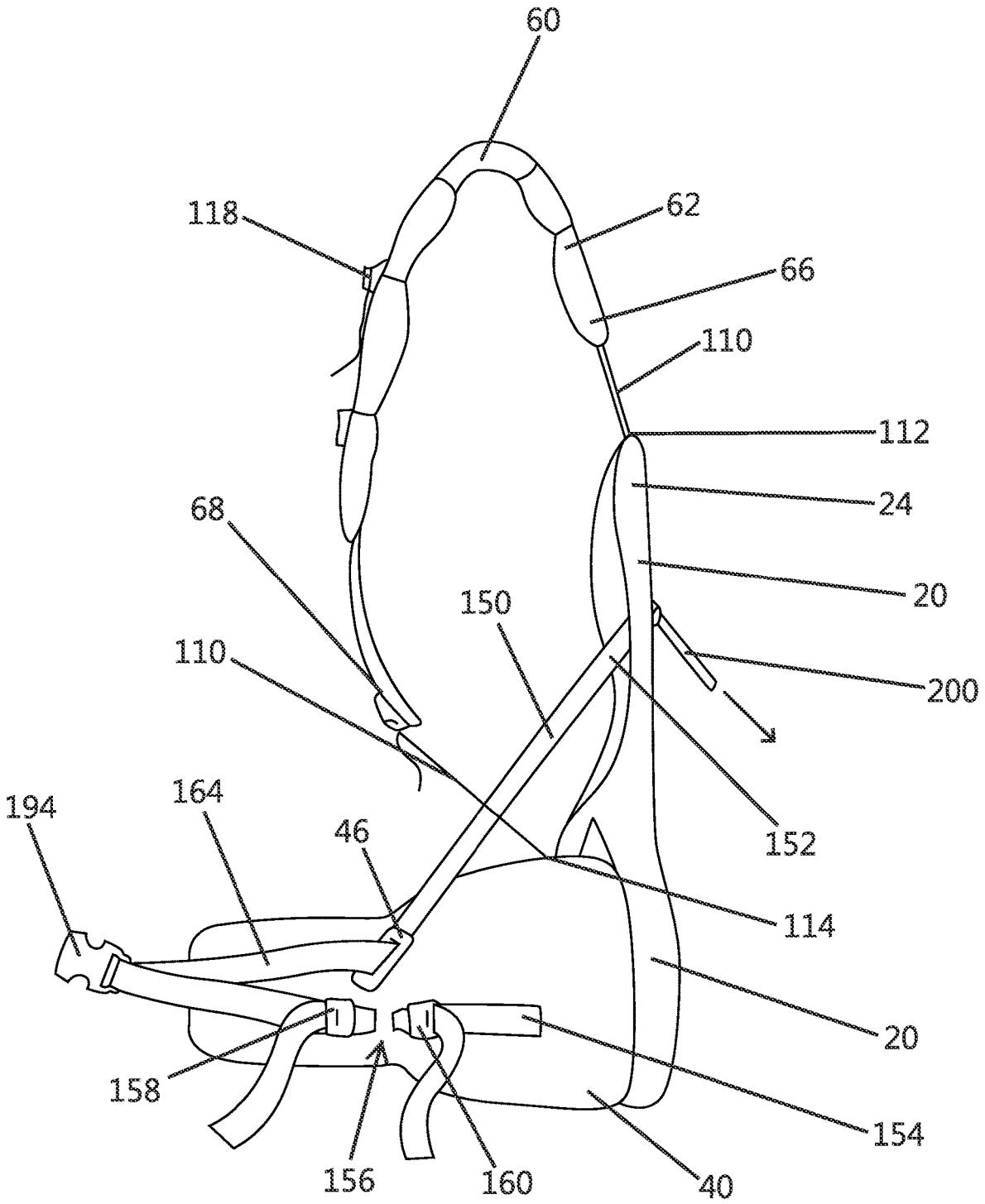
FIG. 3 is a left side view of an embodiment of a golf bag shoulder harness of the present invention.
Figure 4:
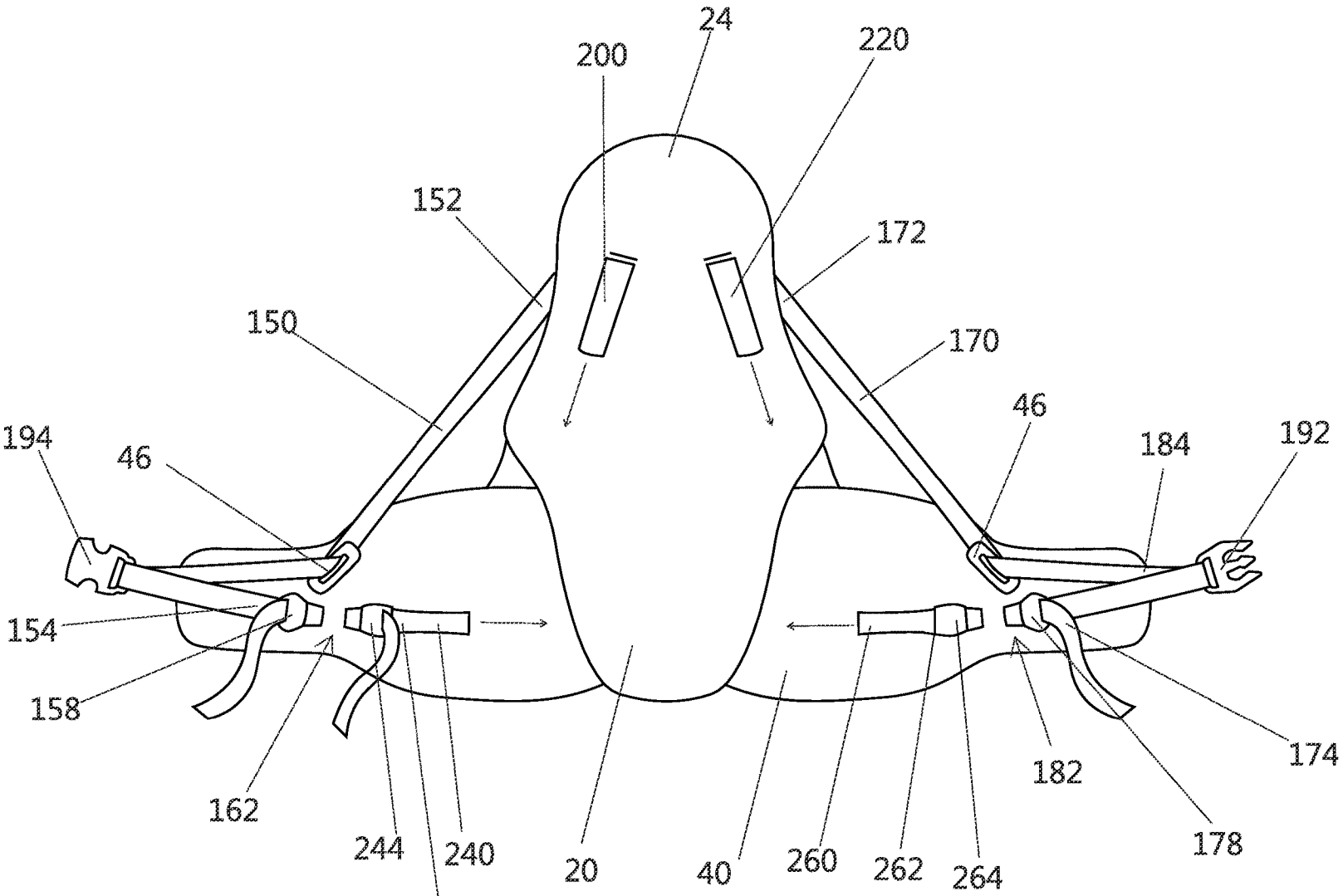
FIG. 4 is a back view of an embodiment of a golf bag shoulder harness of the present invention having the shoulder straps and first and second cinching straps removed.
Figure 5:
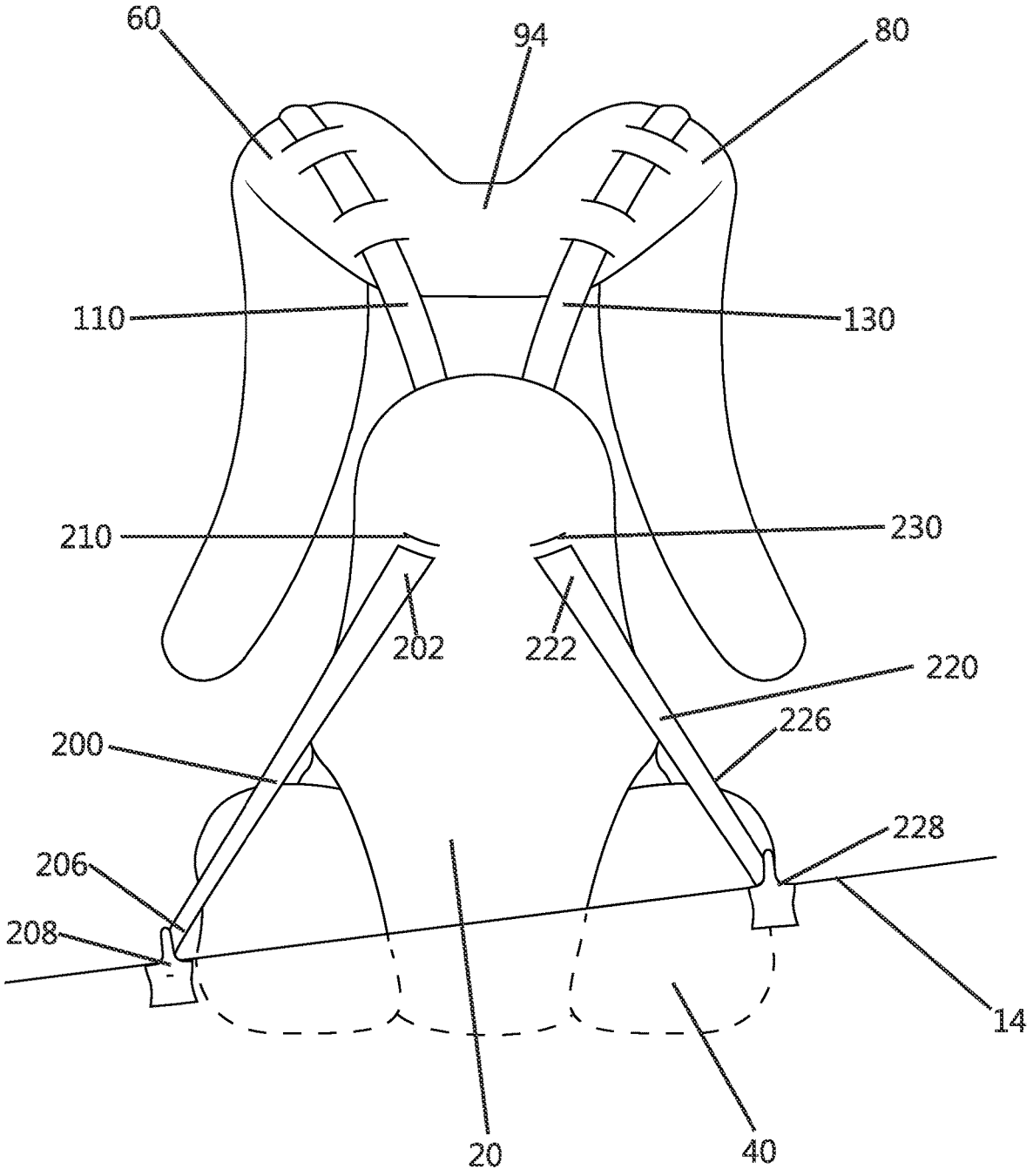
FIG. 5 is a partial sectioned back view of an embodiment of a golf bag shoulder harness of the present invention shown coupled to a portion of a golf bag.
Figure 6:
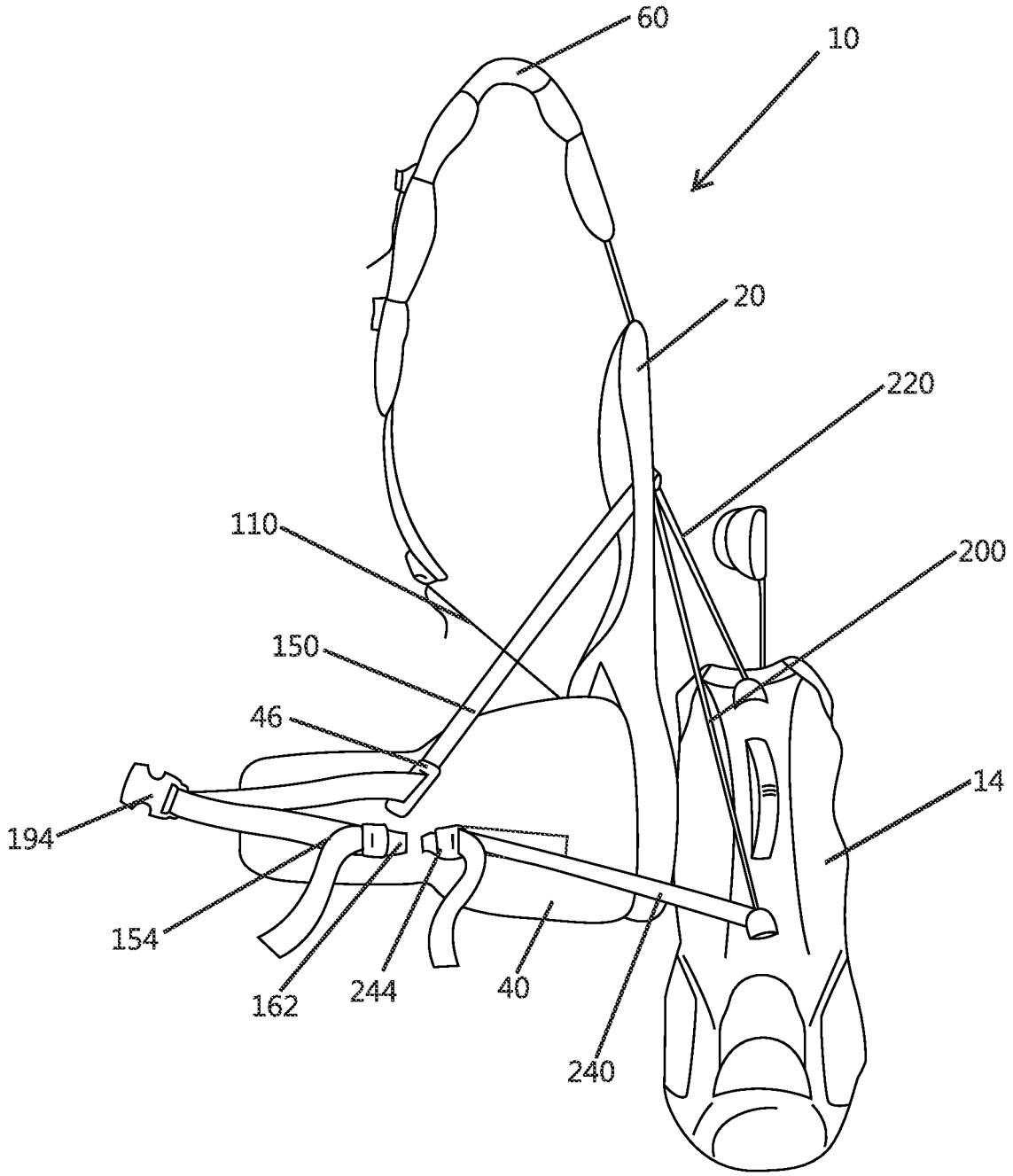
FIG. 6 is a left side view of an embodiment of a golf bag shoulder harness of the present invention shown attached to a golf bag wherein portions of the cinching straps are illustrated as removed.

With reference to the Figures, while multiple embodiments are depicted some of the Figures do not illustrate shoulder straps, portions of the cinch straps, and interconnections thereby better illustrating the remaining features of the invention. Referring first to FIGS. 1-6 the golf bag harness apparatus 10 is illustrated for quick coupling to a golf bag 14. The harness includes a lumbar support 20 coupled to hip belt 40. The lumbar support 20 includes padding 22 and the hip belt 40 includes padding 42. The padding may be foam filled or alternatively the lumbar support 20 and hip belt 40 may be constructed from a material that provides padding inherent in the material itself. Those skilled in the art will appreciate that the lumbar support 20 of the various embodiments described herein may include an internal or external rigid frame that provides support and distributes the load.

Contoured or shape profiled first and second shoulder straps 60 and 80 are interconnected at corresponding first ends 66 and 86 of the straps by an interconnecting shoulder strap 94. During manufacture the shoulder straps 60, 80 and interconnecting strap 94 may be manufactured separately and sewn or otherwise attached together. Alternatively, during manufacture straps 60, 80 and interconnecting strap 94 may be manufactured as a continuous member. The shoulder straps 60 and 80 further include respective padding 62 and 82. Loops 64 and 84 are formed on corresponding shoulder straps 60 and 80 that provide additional securement of the cinching straps 110 and 130 to the respective shoulder straps. The shoulder straps are further interconnected and coupled together with a cinching chest strap 96. The chest cinching strap 96 is split and coupled together with a side release buckle 98 or other suitable quick release member. The side release buckle 98 of known suitable construction further allows for adjustment of the length of the chest cinching strap 96.

The shoulder straps 60 and 80 are coupled to the lumbar support 20 and hip belt 40 with corresponding first and second cinching straps 110 and 130. The length adjustable first cinching strap 110 has a first end 112 that links, couples or attaches a first end 66 of the first padded shoulder strap 60 to an upper end 24 of the padded lumbar support 20. The first cinching strap 110 further has a second end 114 that links, couples or attaches a second end 68 of the first padded shoulder strap 60 to either the padded lumbar support 20 or the padded hip belt 40. Similarly, the length adjustable second cinching strap 130 has a first end 132 that links, couples or attaches a first end 86 of the second padded shoulder strap 80 to the upper end 24 of the padded lumbar support 20. The second cinch strap 130 further has a second end 134 that links, couples or attaches a second end 88 of the second padded shoulder strap 80 to either the padded lumbar support 20 or the padded hip belt 40. Straps 110 and 130 may further include a split or division 116 and 136 and may be further interconnected with ladder lock slider buckles 118 and 138. Additionally, slides 120 and 140 may be coupled to the straps. The additional buckles and slides further provide adjustability to the length of the straps 110 and 130.

The hip belt 40 is further coupled to the lumbar support 20 with third and fourth cinch straps 150 and 170 respectively. The length adjustable third cinching strap 150 has a first end 152 that links, couples or attaches to the upper end 24 of the padded lumbar support 20. The third cinching strap 150 further includes a second end 154 that is linked, coupled or attached to the padded hip belt 40. A mid portion 164 of the third cinch 150 has a second half 194 of an adjustable connecting buckle or side release buckle 190 coupled thereto. The second end 154 may be split and include a first 158 and second 160 halves of a quick release buckle to form an interconnect 162. Alternatively, only one half of the buckle may be coupled to the end of the third cinch strap 150 and the other halve of a quick release buckle may be coupled to a corresponding interconnecting strap 240. Likewise, the fourth cinching strap 170 has a first end 172 linked, coupled or attached to the upper end 24 of the padded lumbar support 20. The fourth cinching strap 170 further includes a second end 174 that is linked, coupled or attached to the padded hip belt 40. A mid portion 184 of the third cinch 170 has a first half 192 of an adjustable connecting buckle or side release buckle 190 coupled thereto. The second end 174 may be split and include a first halve 178 (FIG. 4) and second halve 264 of a quick release buckle to form an interconnect 182. Alternatively, only one half of the buckle may be coupled to the fourth cinch strap 170 and the other halve of a quick release buckle may be coupled to a corresponding interconnecting strap 260.

The first interconnecting strap 200 and second interconnecting strap 220 interconnects an upper portion 24 of the lumbar support 20 to the golf bag 14. The first interconnecting strap 200 has a first end 202 linked, coupled or attached to the upper end 24 of the padded lumbar support 20 and a second end 206 adapted to couple to a golf bag. The first end may be fixed to the lumbar support or may extend through interconnecting slot 28 and fixed to the first end 152 of the third cinching strap 150. Similarly, the second interconnecting strap 220 has a first end 222 linked, coupled or attached to the upper end 24 of the padded lumbar support 20 and a second end 226 adapted to couple to golf bag 14. The first end 222 may be fixed to the lumbar support 20 or may extend through interconnecting slot 28 and fix or couple to the first end 172 of the fourth cinching strap 170.

The third interconnecting strap 240 and fourth interconnecting strap 260 interconnects the hip belt 40 to the golf bag 14. The third interconnecting strap 240 has a first end 242 linked, coupled or attached to the padded hip belt 40 and a second end 246 adapted to couple to the golf bag. Likewise, the fourth interconnecting strap 260 has a first end 262 linked, coupled or attached to the padded hip belt 40 and a second end 266 adapted to couple to the golf bag 14. The first end 242 of the third interconnecting strap 240 may include a quick release buckle 244 that couples to the end of the third cinching strap 150. The quick release buckle 244 allows the user to quickly attach and detach the third interconnecting member 240 to the hip belt 40. Further, the second end 246 may include a quick release clasp, clip or buckle 248 that allows the user to quickly attach and detach the third interconnecting member 240 to the golf bag. The first end 262 of the fourth interconnecting strap 260 may include a quick release buckle 264 that couples to the end of the fourth cinching strap 170. The quick release buckle 264 allows the user to quickly attach and detach the third interconnecting member 260 to the hip belt 40. Further, the second end 266 may include a quick release clasp, clip or buckle 268 that allows the user to quickly attach and detach the third interconnecting member 260 to the golf bag.

Figure 7:
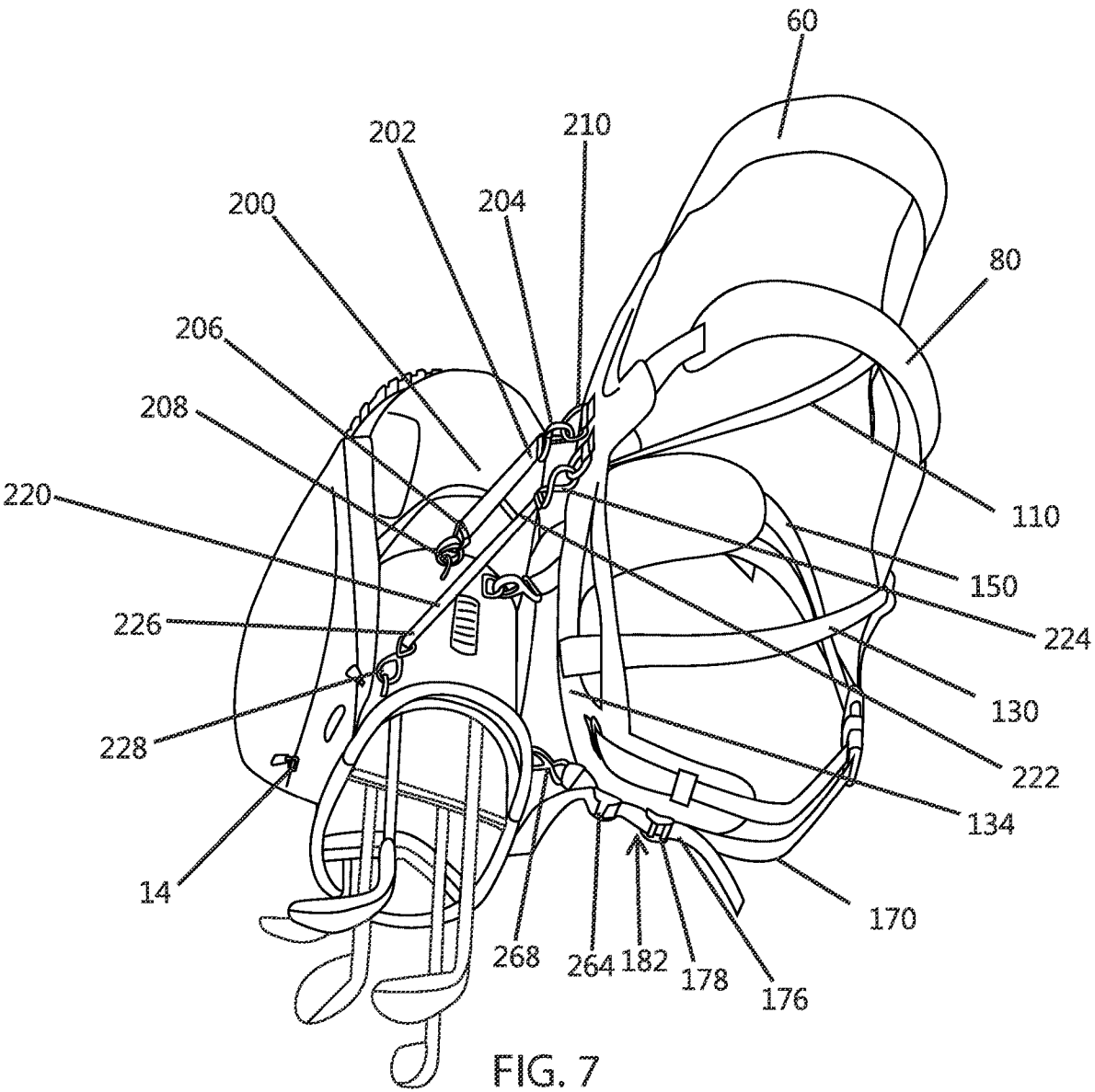
FIG. 7 is a top right side perspective view of an embodiment of a golf bag shoulder harness of the present invention shown attached to a golf bag.
Figure 8:
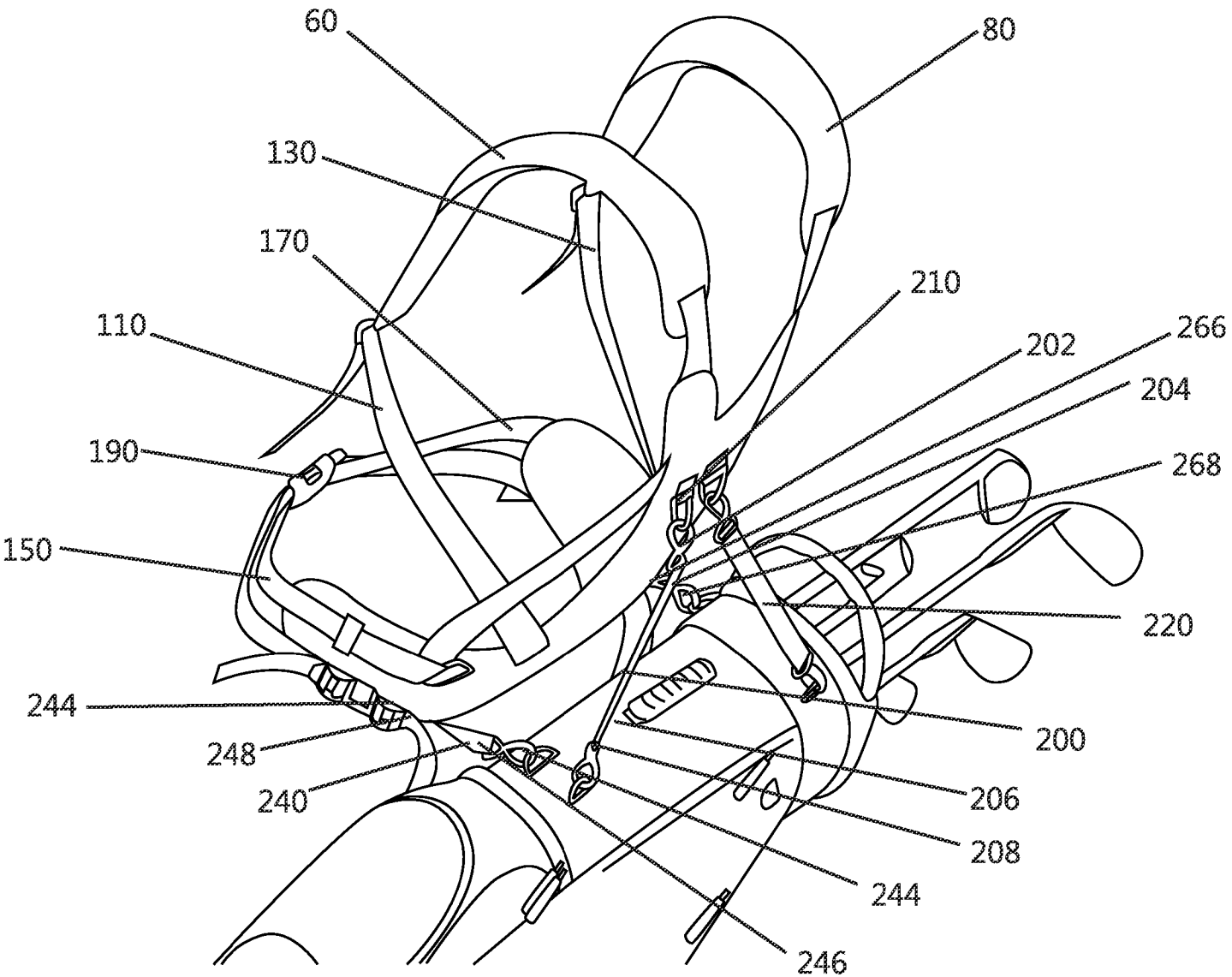
FIG. 8 is a top left side perspective view of an embodiment of a golf bag shoulder harness of the present invention shown attached to a golf bag.
Figure 9:
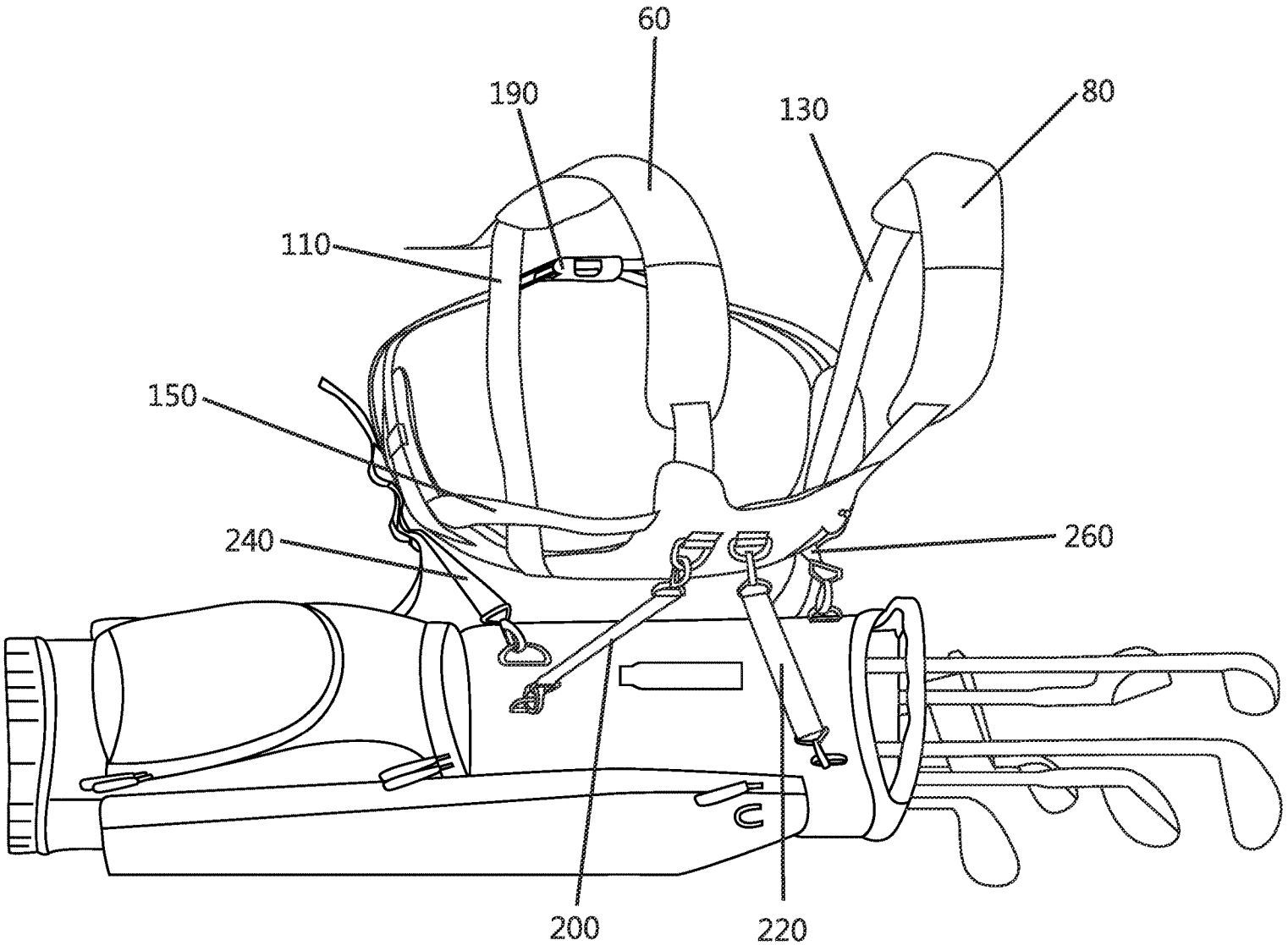
FIG. 9 is a top back perspective view of an embodiment of a golf bag shoulder harness of the present invention shown attached to a golf bag.
Figure 10:
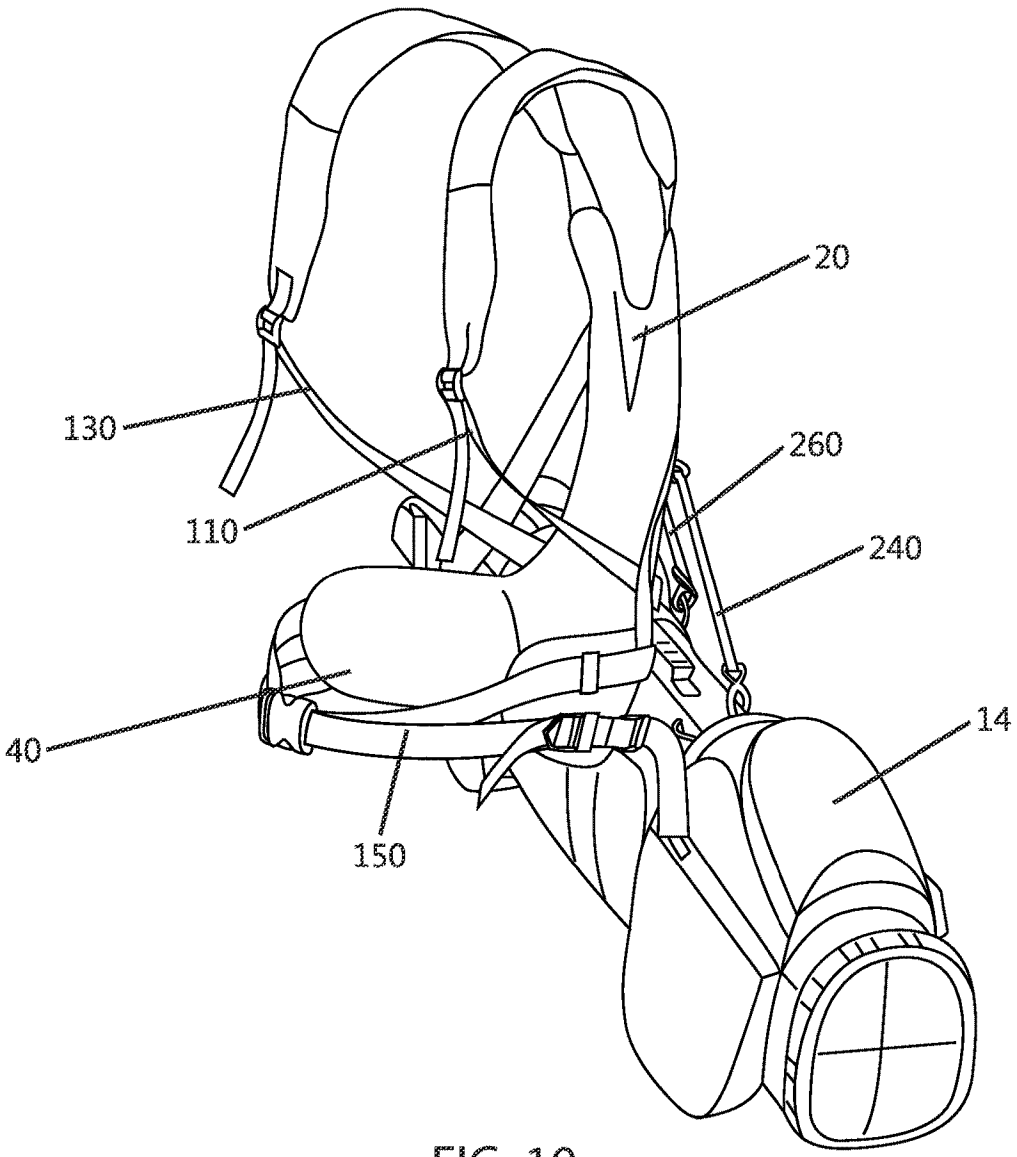
FIG. 10 is a front right side perspective view of an embodiment of a golf bag shoulder harness of the present invention shown attached to a golf bag.
Figure 11:
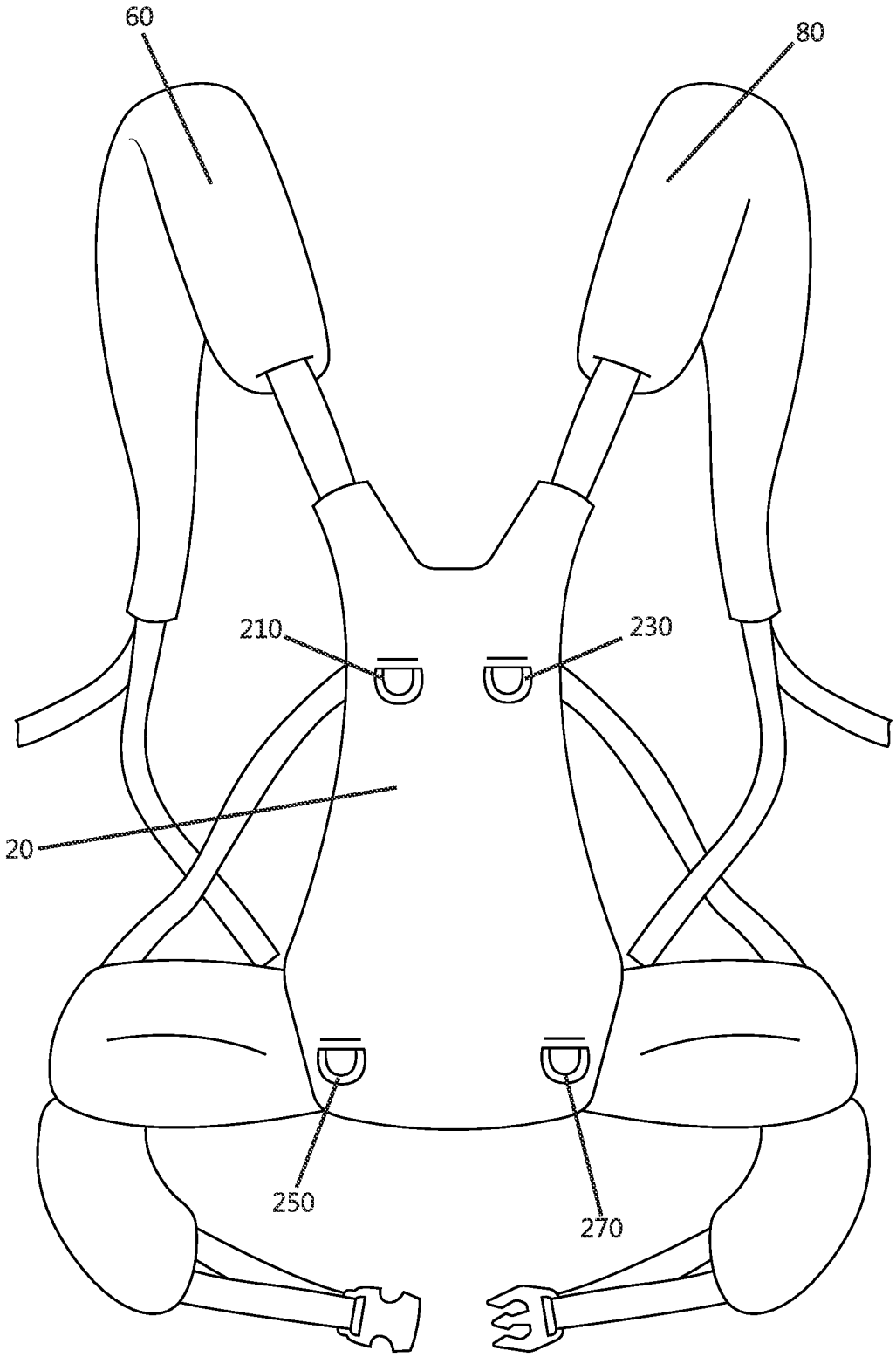
FIG. 11 is a back perspective view of an embodiment of a golf bag shoulder harness of the present invention showing D-rings coupled to the lumbar support.
Figure 12:
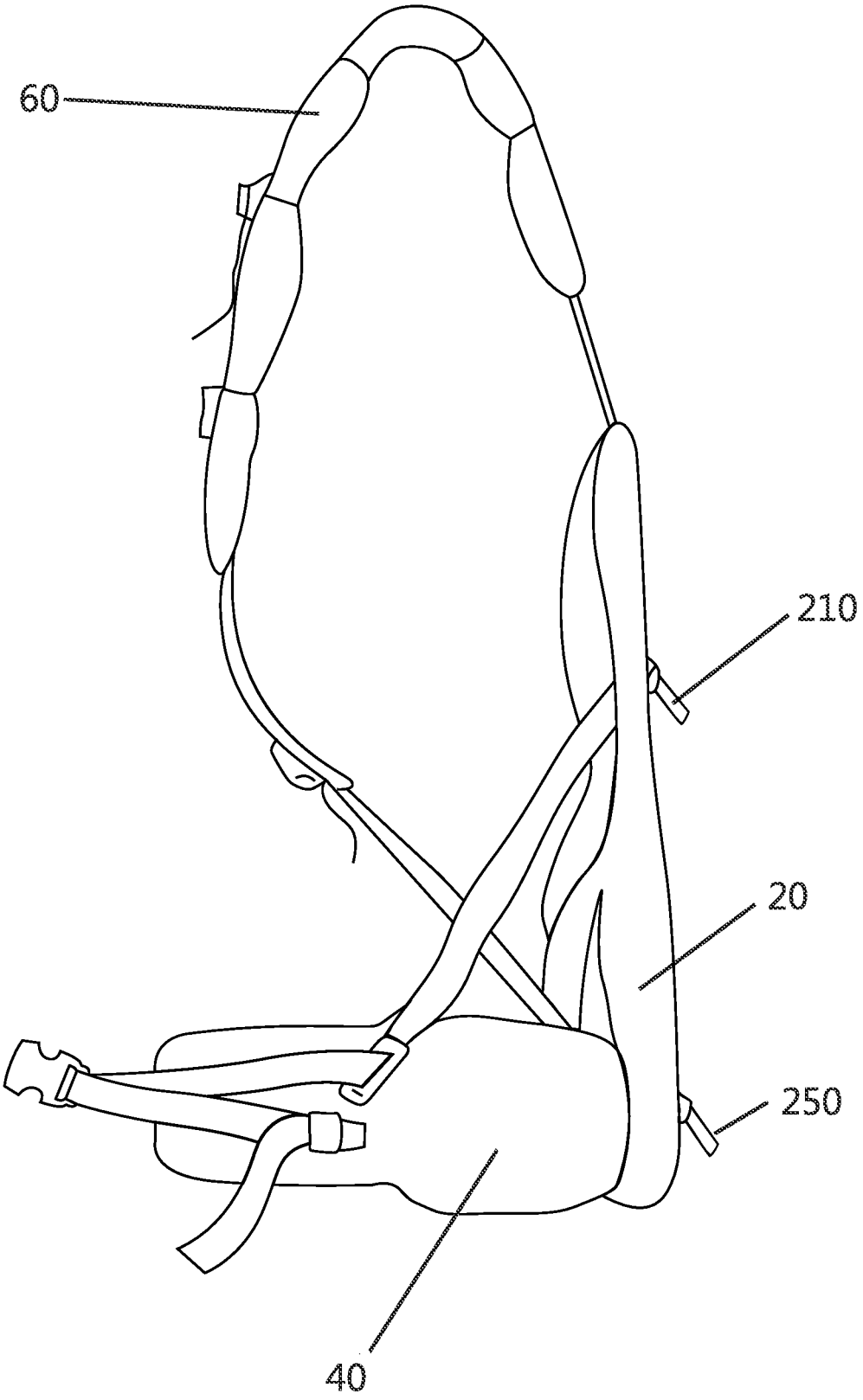
FIG. 12 is a left side view of an embodiment of a golf bag shoulder harness of the present invention.
Figure 13:
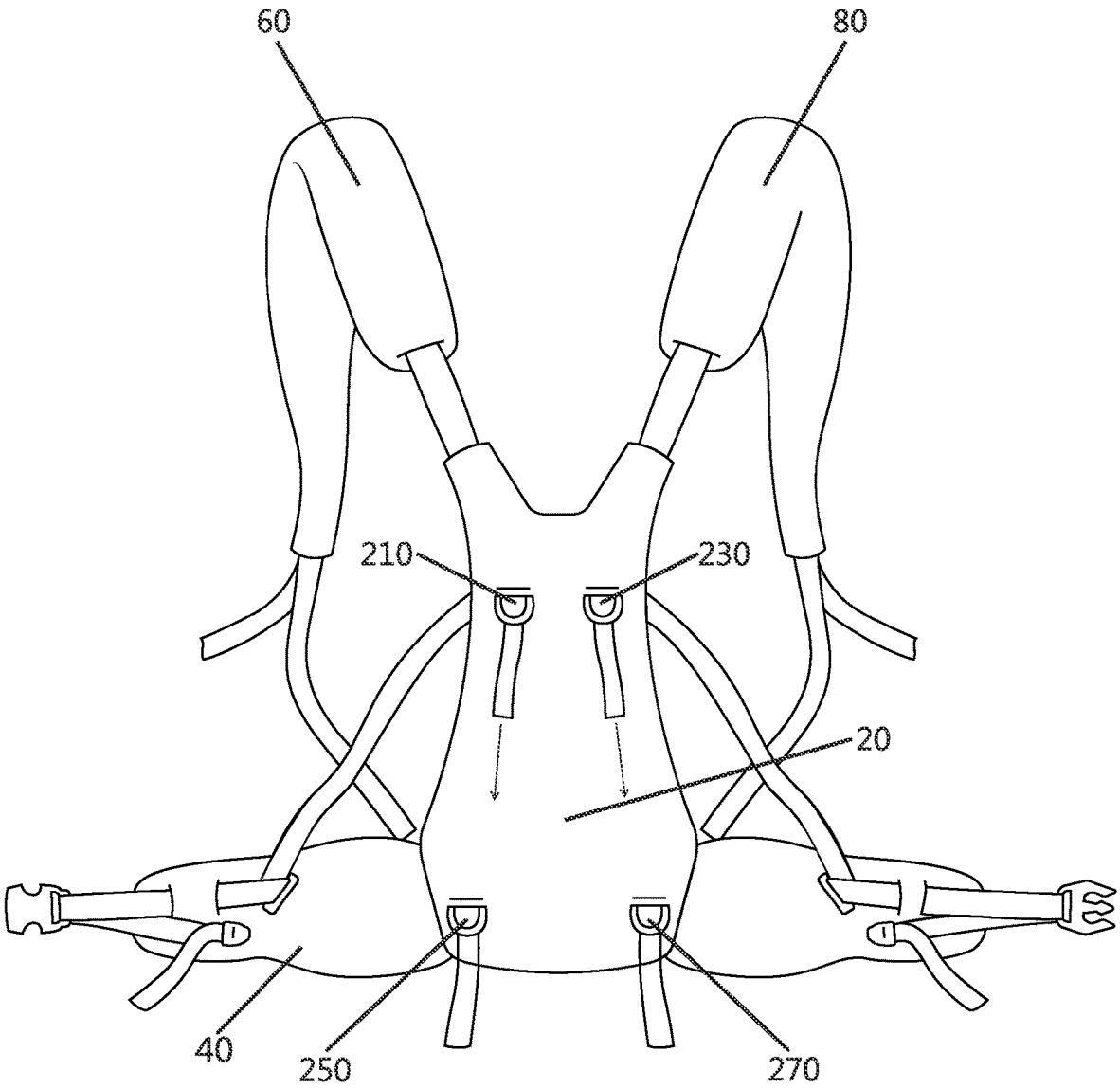
FIG. 13 is a back perspective view of an embodiment of a golf bag shoulder harness of the present invention showing D-rings coupled to the lumbar support.
Figure 14:
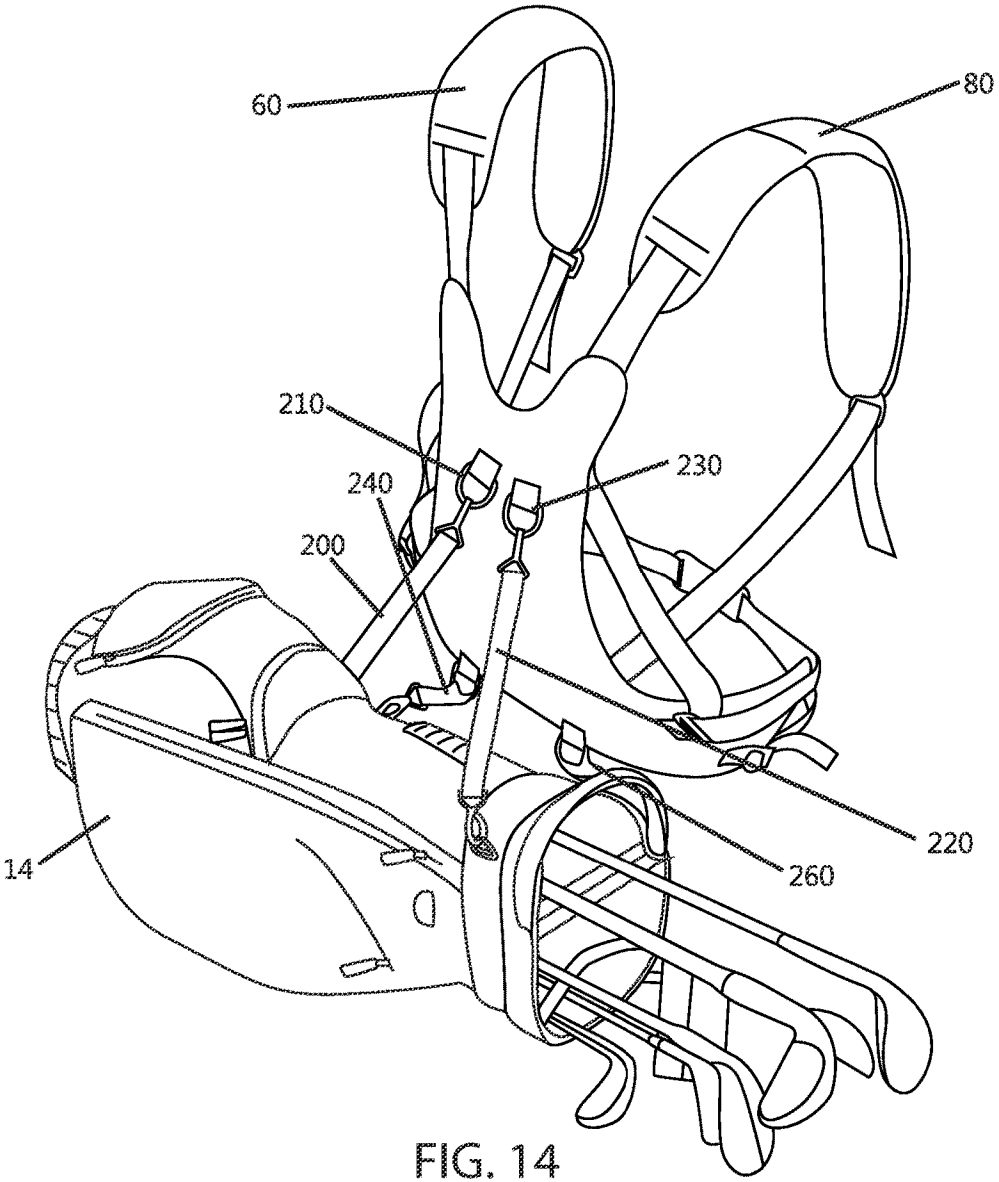
FIG. 14 is a top right side perspective view of an embodiment of a golf bag shoulder harness of the present invention shown attached to a golf bag.
Figure 15:
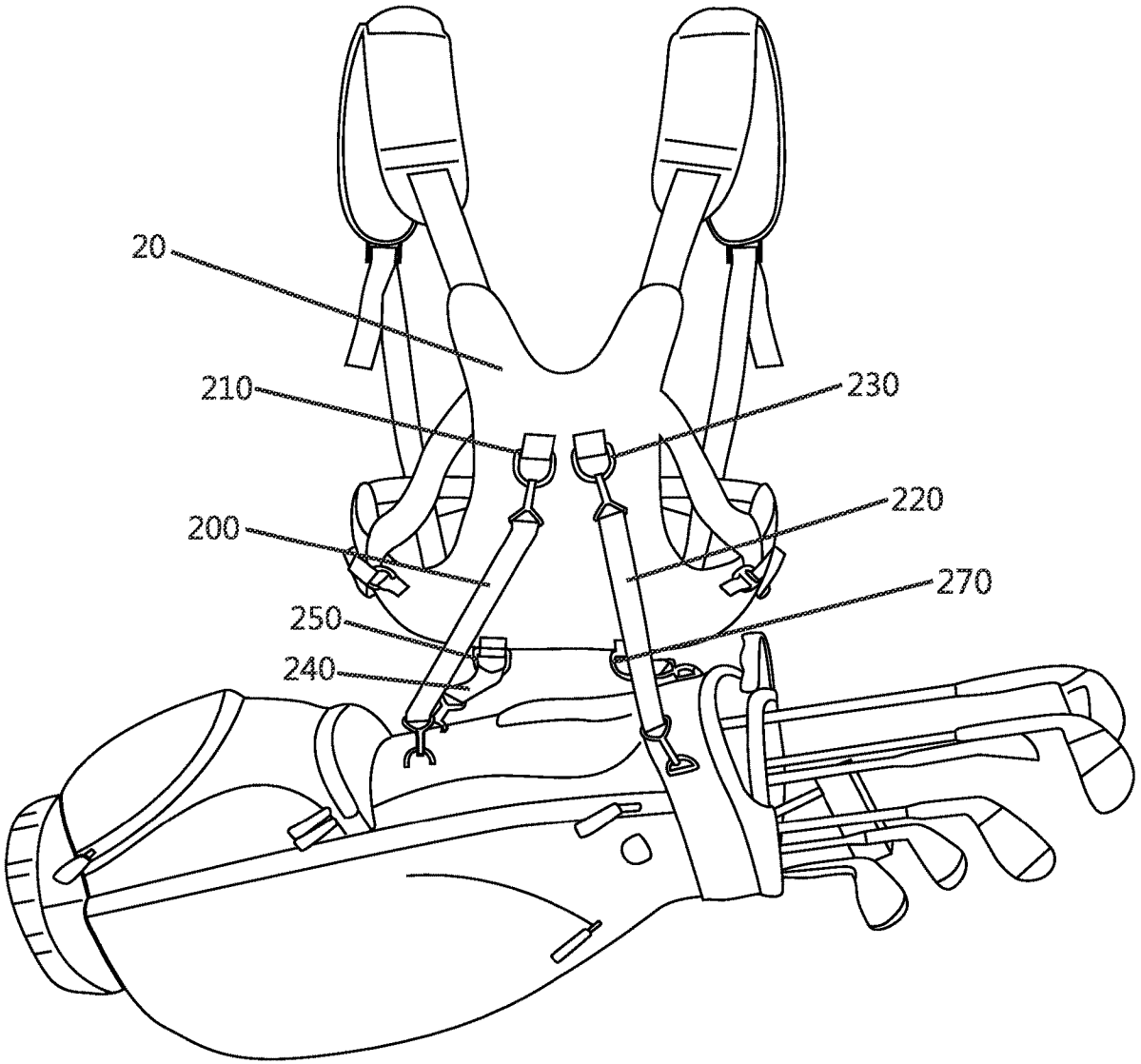
FIG. 15 is a top back perspective view of an embodiment of a golf bag shoulder harness of the present invention shown attached to a golf bag.
Figure 16:
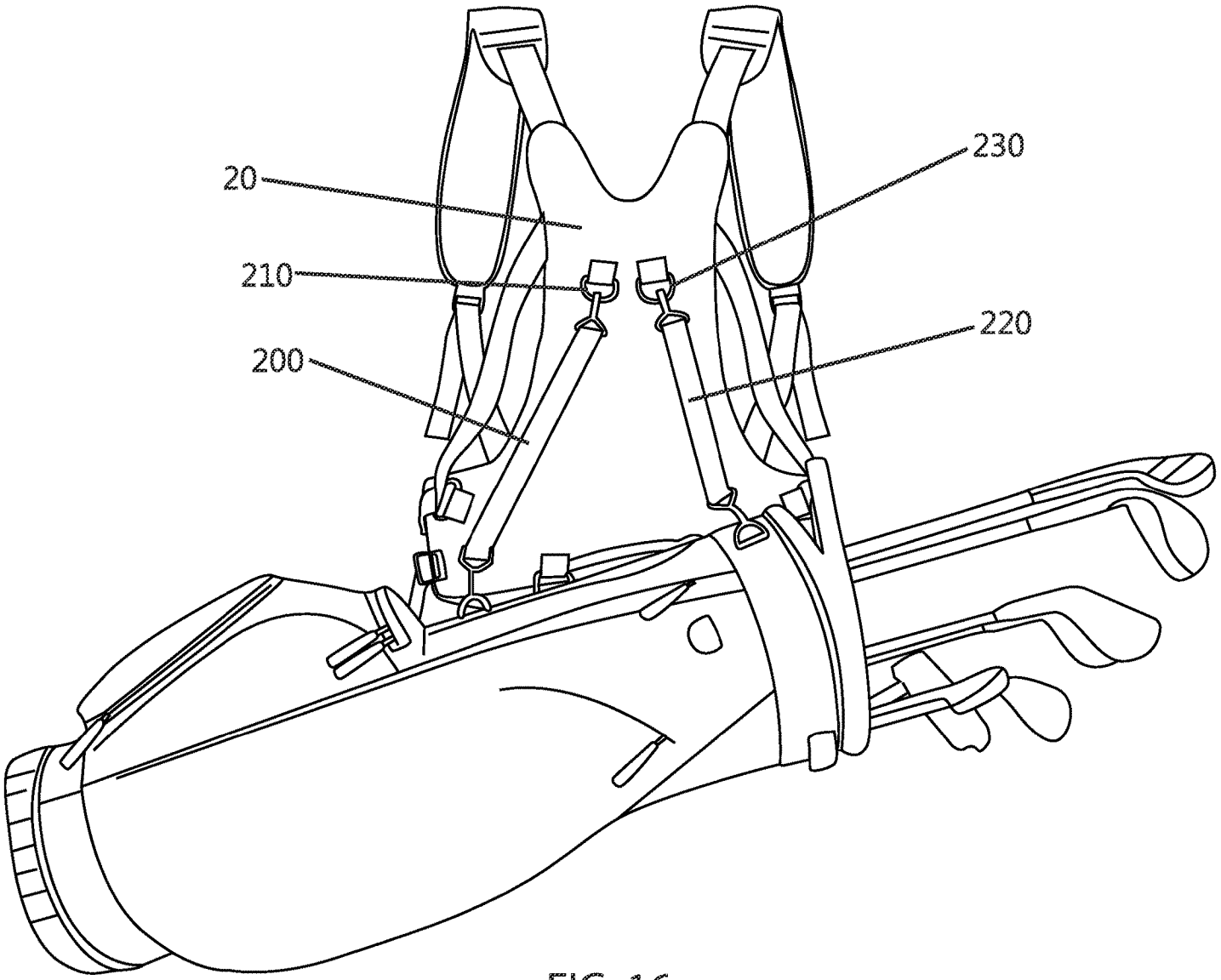
FIG. 16 is a back perspective view of an embodiment of a golf bag shoulder harness of the present invention shown attached to a golf bag.
Figure 17:
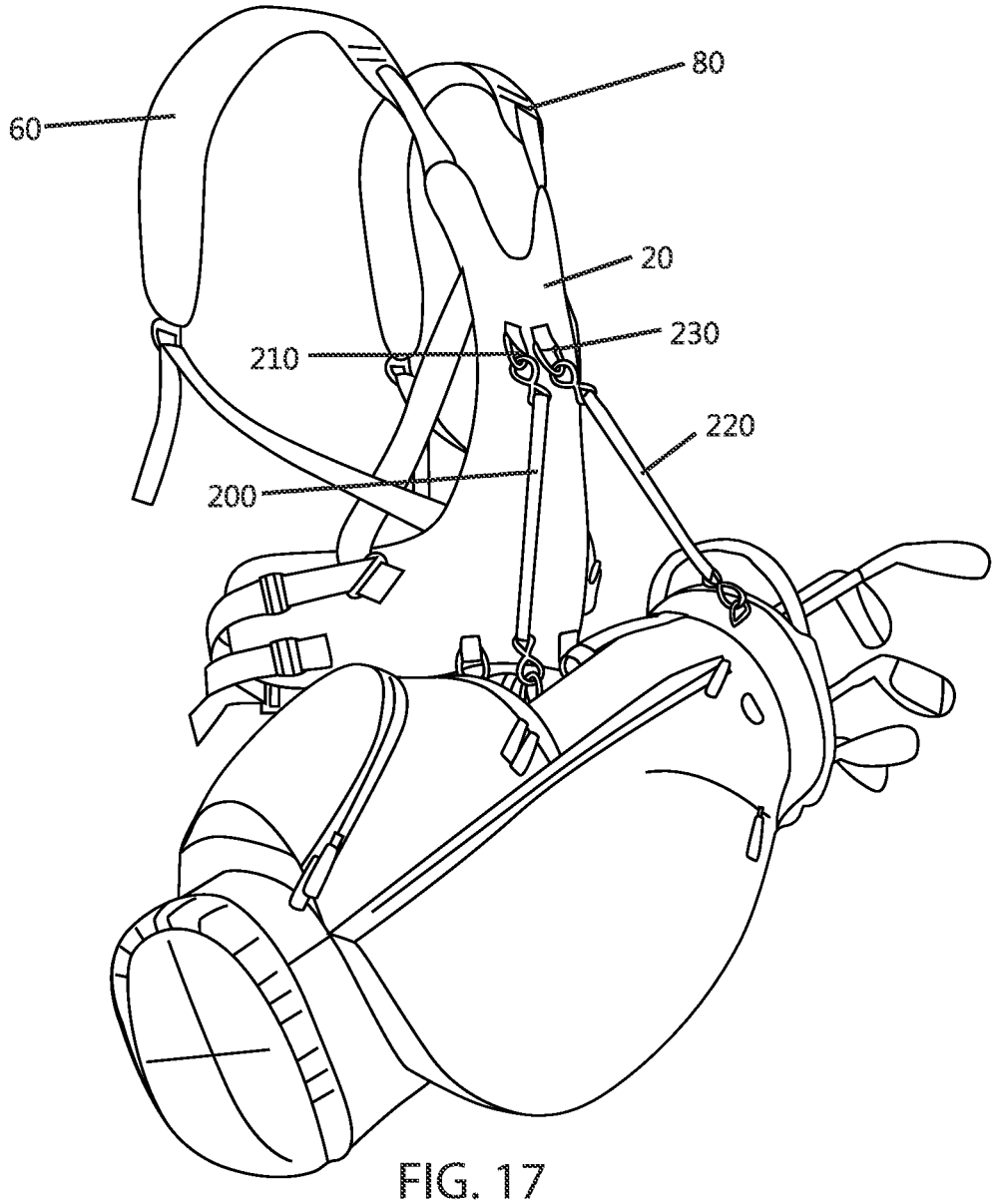
FIG. 17 is a left perspective view of an embodiment of a golf bag shoulder harness of the present invention shown attached to a golf bag.
Figure 18:
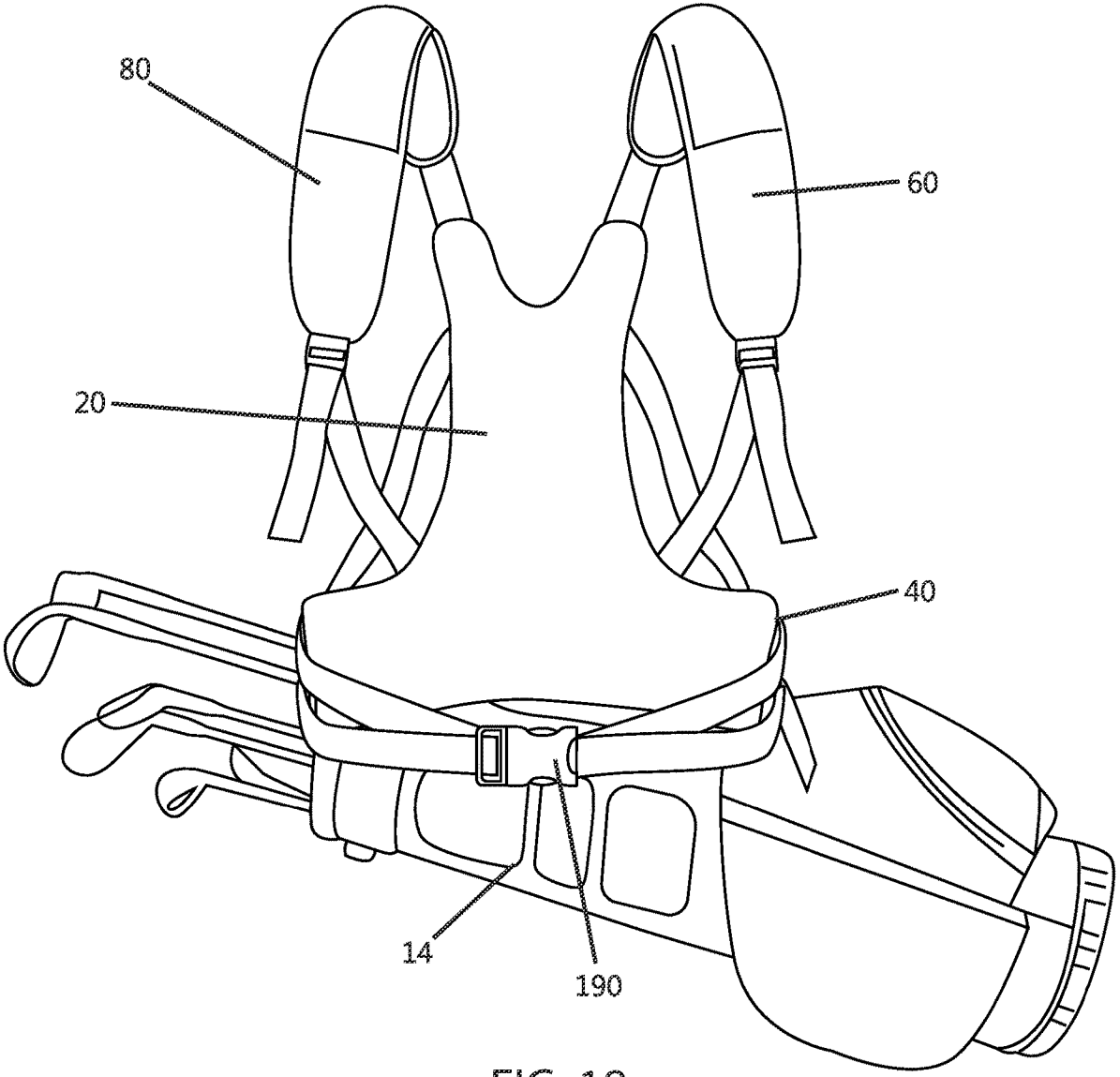
FIG. 18. is a front perspective view of an embodiment of a golf bag shoulder harness of the present invention shown attached to a golf bag.

An alternate embodiment illustrated in FIGS. 7-18 shows the first end 202 of the first interconnecting strap 200 coupled to a D loop 210 fixed to an upper portion 24 of the lumbar support 20. Similarly, the first end 222 of the second interconnecting strap 220 is coupled to a D loop 230 fixed to an upper portion 24 of the lumbar support 20. Similarly, the first end 242 of the third interconnecting strap 240 is coupled to a D loop 250 fixed to a lower portion 26 of the lumbar support 20. Similarly, the first end 262 of the fourth interconnecting strap 260 is coupled to a D loop 270 fixed to a lower portion 26 of the lumbar support 20.

In use, the user inserts their arms through the shoulder straps and then wraps the hip belt 40 around the waist. Buckle 190 is used to secure the hip belt in place around the user's waist. The buckles 158 and 178 may be used to adjust the length of the straps 150 and 170 such that hip belt 40 may be tightened or loosened. The user may couple the buckle 98 of the chest cinch strap 96 to further secure the shoulder straps 60 and 80 to help reduce the likelihood that the straps fall away from the shoulders of the user. The length of the first and second cinching straps may be adjusted to provide a controlled fit of the shoulder straps on the user's shoulders. Once the harness 10 is fully adjusted on the user the buckles or quick release clasps associated with the first, second, third and fourth interconnecting straps 200, 220, 240 and 260 may be utilized to thereby couple the ends of the interconnecting straps to the golf bag 14. Once the golf bag 14 is coupled to the harness the user may further adjust the lengths of the cinch straps to selectively distribute the weight of the bag to the shoulders and hips of the user.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A golf bag harness apparatus for quick coupling to a golf bag, the apparatus comprising:

padded lumbar support;

padded hip belt;

first and second padded shoulder straps;

a length adjustable first cinching strap having a first end that links a first end of the first padded shoulder strap to an upper end of the padded lumbar support and having a second end that links a second end of the first padded shoulder strap to at least one of the padded lumbar support and the padded hip belt;

a length adjustable second cinching strap having a first end that links a first end of the second padded shoulder strap to the upper end of the padded lumbar support and having a second end that links a second end of the second padded shoulder strap to at least one of the padded lumbar support and the padded hip belt;

a length adjustable cinching chest strap interconnecting the first and second shoulder straps;

a length adjustable third cinching strap having a first end linked to the upper end of the padded lumbar support, a second end linked to the padded hip belt, and a mid portion coupled to a first half of a belt buckle;

a length adjustable fourth cinching strap having a first end linked to the upper end of the padded lumbar support, a second end linked to the padded hip belt, and a mid portion coupled to a second half of a belt buckle;

a first interconnecting strap having a first end linked to the upper end of the padded lumbar support and a second end adapted to couple to a golf bag;

a second interconnecting strap having a first end linked to the upper end of the padded lumbar support and a second end adapted to couple to the golf bag;

a third interconnecting strap having a first end linked to the padded hip belt and a second end adapted to couple to the golf bag; and a fourth interconnecting strap having a first end linked to the padded hip belt and a second end adapted to couple to the golf bag.

2. The apparatus as recited in claim 1, wherein the second end of the third cinching strap is further linked to the first end of the third interconnecting strap.

3. The apparatus as recited in claim 1, wherein the second end of the fourth cinching strap is further linked to the first end of the fourth interconnecting strap.

4. The apparatus as recited in claim 1, wherein the first end of the first cinching strap is further linked to the first end of the first interconnecting strap.

5. The apparatus as recited in claim 1, wherein the first end of the second cinching strap is further linked to the first end of the second interconnecting strap.

6. The apparatus as recited in claim 1, wherein the first interconnecting strap couples to the golf bag with a first coupling member.

7. The apparatus as recited in claim 1, wherein the second interconnecting strap couples to the golf bag with a second coupling member.

8. The apparatus as recited in claim 1, wherein the third interconnecting strap couples to the golf bag with a third coupling member.

9. The apparatus as recited in claim 1, wherein the fourth interconnecting strap couples to the golf bag with a fourth coupling member.

10. The apparatus as recited in claim 1, wherein the first end of the first padded shoulder strap interconnects with a first end of the second padded shoulder strap.

11. A golf bag harness apparatus for quick coupling to a golf bag, the apparatus comprising:

padded lumbar support;

padded hip belt;

first and second padded shoulder straps;

a length adjustable first cinching strap having a first end that links a first end of the first padded shoulder strap to an upper end of the padded lumbar support and having a second end that links a second end of the first padded shoulder strap to at least one of the padded lumbar support and the padded hip belt;

a length adjustable second cinching strap having a first end that links a first end of the second padded shoulder strap to the upper end of the padded lumbar support and having a second end that links a second end of the second padded shoulder strap to at least one of the padded lumbar support and the padded hip belt;

a length adjustable cinching chest strap interconnecting the first and second shoulder straps;

a length adjustable third cinching strap having a first end linked to the upper end of the padded lumbar support, a second end linked to the padded hip belt, and a mid portion coupled to a first half of a belt buckle;

a length adjustable fourth cinching strap having a first end linked to the upper end of the padded lumbar support, a second end linked to the padded hip belt, and a mid portion coupled to a second half of a belt buckle;

a first interconnecting strap having a first end linked to the upper end of the padded lumbar support and a second end adapted to couple to a golf bag, wherein the first end of the first cinching strap is further linked to the first end of the first interconnecting strap;

a second interconnecting strap having a first end linked to the upper end of the padded lumbar support and a second end adapted to couple to the golf bag, wherein the first end of the second cinching strap is further linked to the first end of the second interconnecting strap;

a third interconnecting strap having a first end linked to the padded hip belt and a second end adapted to couple to the golf bag, wherein the second end of the third cinching strap is further linked to the first end of the third interconnecting strap; and a fourth interconnecting strap having a first end linked to the padded hip belt and a second end adapted to couple to the golf bag, wherein the second end of the fourth cinching strap is further linked to the first end of the fourth interconnecting strap.

12. The apparatus as recited in claim 11, wherein the first interconnecting strap couples to the golf bag with a first coupling member.

13. The apparatus as recited in claim 11, wherein the second interconnecting strap couples to the golf bag with a second coupling member.

14. The apparatus as recited in claim 11, wherein the third interconnecting strap couples to the golf bag with a third coupling member.

15. The apparatus as recited in claim 11, wherein the fourth interconnecting strap couples to the golf bag with a fourth coupling member.

16. The apparatus as recited in claim 11, wherein the first end of the first padded shoulder strap interconnects with a first end of the second padded shoulder strap.

17. A golf bag harness apparatus for quick coupling to a golf bag, the apparatus comprising:

padded lumbar support;

padded hip belt;

first and second padded shoulder straps;

a length adjustable first cinching strap having a first end that links a first end of the first padded shoulder strap to an upper end of the padded lumbar support and having a second end that links a second end of the first padded shoulder strap to at least one of the padded lumbar support and the padded hip belt;

a length adjustable second cinching strap having a first end that links a first end of the second padded shoulder strap to the upper end of the padded lumbar support and having a second end that links a second end of the second padded shoulder strap to at least one of the padded lumbar support and the padded hip belt;

a length adjustable cinching chest strap interconnecting the first and second shoulder straps;

a length adjustable third cinching strap having a first end linked to the upper end of the padded lumbar support, a second end linked to the padded hip belt, and a mid portion coupled to a first half of a belt buckle;

a length adjustable fourth cinching strap having a first end linked to the upper end of the padded lumbar support, a second end linked to the padded hip belt, and a mid portion coupled to a second half of a belt buckle;

a first interconnecting strap having a first end linked to the upper end of the padded lumbar support and a second end adapted to couple to a golf bag, wherein the first end of the first cinching strap is further linked to the first end of the first interconnecting strap;

a second interconnecting strap having a first end linked to the upper end of the padded lumbar support and a second end adapted to couple to the golf bag, wherein the first end of the second cinching strap is further linked to the first end of the second interconnecting strap;

a third interconnecting strap having a first end linked to the padded hip belt and a second end adapted to couple to the golf bag, wherein the second end of the third cinching strap is further linked to the first end of the third interconnecting strap;

a fourth interconnecting strap having a first end linked to the padded hip belt and a second end adapted to couple to the golf bag, wherein the second end of the fourth cinching strap is further linked to the first end of the fourth interconnecting strap; and wherein the first interconnecting strap couples to the golf bag with a first coupling member, the second interconnecting strap couples to the golf bag with a second coupling member, the third interconnecting strap couples to the golf bag with a third coupling member, and the fourth interconnecting strap couples to the golf bag with a fourth coupling member.

18. The apparatus as recited in claim 17, wherein the first end of the first padded shoulder strap interconnects with a first end of the second padded shoulder strap.

* * * * *